US011662069B1

(12) United States Patent
Huang

(10) Patent No.: US 11,662,069 B1
(45) Date of Patent: May 30, 2023

(54) CAMPING LAMP

(71) Applicant: SHENZHEN FEIHE ELECTRONICS CO., LTD, Shenzhen (CN)

(72) Inventor: Weiping Huang, Shenzhen (CN)

(73) Assignee: SHENZHEN FEIHE ELECTRONICS CO., LTD, Shenzhen (CN)

( * ) Notice: Subject to any disclaimer, the term of this patent is extended or adjusted under 35 U.S.C. 154(b) by 0 days.

(21) Appl. No.: 17/941,157

(22) Filed: Sep. 9, 2022

(51) Int. Cl.

| | |
|---|---|
| ***F21L 4/08*** | (2006.01) |
| ***F21V 23/00*** | (2015.01) |
| ***F21V 3/06*** | (2018.01) |
| ***F21S 9/03*** | (2006.01) |
| ***F21Y 115/10*** | (2016.01) |

(52) U.S. Cl.
CPC ..... *F21L 4/08* (2013.01); *F21S 9/037* (2013.01); *F21V 3/06* (2018.02); *F21V 23/004* (2013.01); *F21Y 2115/10* (2016.08)

(58) Field of Classification Search
CPC .. F21L 4/08; F21V 3/06; F21V 23/004; F21S 9/037
See application file for complete search history.

(56) References Cited

U.S. PATENT DOCUMENTS

| | | | | |
|---|---|---|---|---|
| 7,794,124 | B2 * | 9/2010 | Hulsey | B63B 45/04 362/540 |
| 10,359,173 | B2 * | 7/2019 | Chun | F21V 3/02 |
| 10,584,840 | B2 * | 3/2020 | Ashmore | F21V 29/70 |
| 10,704,746 | B2 * | 7/2020 | Jeong | H05B 45/10 |
| 10,760,746 | B2 * | 9/2020 | Sreshta | H02J 7/0047 |
| 11,268,663 | B2 * | 3/2022 | Salzinger | F21L 4/08 |
| 11,346,531 | B2 * | 5/2022 | Brown | F21V 19/0045 |
| 11,435,067 | B1 * | 9/2022 | Wood | F21V 21/22 |
| 2009/0175034 | A1 * | 7/2009 | Allsop | F21V 3/023 362/183 |

* cited by examiner

*Primary Examiner* — Arman B Fallahkhair
(74) *Attorney, Agent, or Firm* — Jeenam Park

(57) ABSTRACT

The present disclosure provides a camping lamp, comprising: a main shell, a light strip, a light-emitting assembly, a battery and a protective cover, the battery is installed inside the main shell, and the light strip is detachably wound on the outer peripheral wall of the main shell, the light-emitting assembly is arranged at the bottom of the main shell, the battery is respectively electrically connected to the light strip and the light-emitting assembly, and the protective cover surrounds the light strip. The present disclosure can be charged by solar energy and direct current power supply, and has a variety of usage modes, which brings great convenience to users, satisfies the needs of users in different application scenarios, and improves user experience.

12 Claims, 7 Drawing Sheets

CAMPING LAMP

CROSS-REFERENCE TO RELATED APPLICATIONS

This application claims priority to Chinese Patent Application No. 202211026459.X, filed on Aug. 25, 2022, the contents of which are herein incorporated by reference in their entireties.

TECHNICAL FIELD

The present disclosure relates to the technical field of camping lights, in particular to a camping lamp.

BACKGROUND

The camping lamp in the prior art often have a single function, and usually only have a simple lighting function, which cannot meet the needs of users in different life scenarios when camping. In addition, the camping lamp in the prior art often use an external DC power supply for charging. When the battery is exhausted, it cannot be conveniently charged during camping, which brings inconvenience to users.

SUMMARY

The present disclosure provides a camping lamp to solve at least one of the above technical problems.

In order to solve the above problems, as an aspect of the present disclosure, a camping lamp is provided, comprising: a main shell, a light strip, a light-emitting assembly, a battery and a protective cover, the battery is installed inside the main shell, the light strip is detachably wound on the outer peripheral wall of the main shell, the light-emitting assembly is arranged at the bottom of the main shell, and the battery is respectively electrically connected to the light strip and the light-emitting assembly, and the protective cover surrounds the light strip.

Wherein, the protective cover is a foldable flexible cover or a light-transmitting cover, one end of the protective cover is connected to the main shell, and the protective cover is folded in a direction away from the light strip and then wraps around the light emitting surface of the light emitting assembly or releases the wrapping around the light strip.

Wherein, the camping lamp further comprises a solar panel, a power circuit board and a hand strap, the solar panel is mounted on the top of the main shell, and the power circuit board is installed inside the main shell, the light-emitting assembly is installed on the bottom surface of the power circuit board, and the hand strap is installed on the top of the main shell.

Wherein, the protective cover is made of silicone, or the hand strap is detachably connected to the main shell.

Wherein, a button is arranged on the bottom surface of the power circuit board.

Wherein, a charging interface is provided on the bottom surface of the power circuit board.

Wherein, a middle frame is installed inside the main shell, and the battery is installed on the middle frame by a battery holder.

Wherein, the bottom of the middle frame is provided with an annular support plate and an annular bottom shell, and the end of the protective cover is located between the annular support plate and the annular bottom shell, the middle frame is provided with a screw for connecting the annular support plate and the annular bottom shell.

Wherein, a lampshade for covering the light-emitting assembly is provided on the main shell.

Wherein, the edge of the lampshade is clamped between the annular bottom shell and the middle frame.

Due to the adoption of the above technical solutions, the present disclosure can be charged by solar energy and DC power supply, and has multiple usage modes, which brings great convenience to users, satisfies the needs of users in different application scenarios, and improves user experience.

Figure 1:
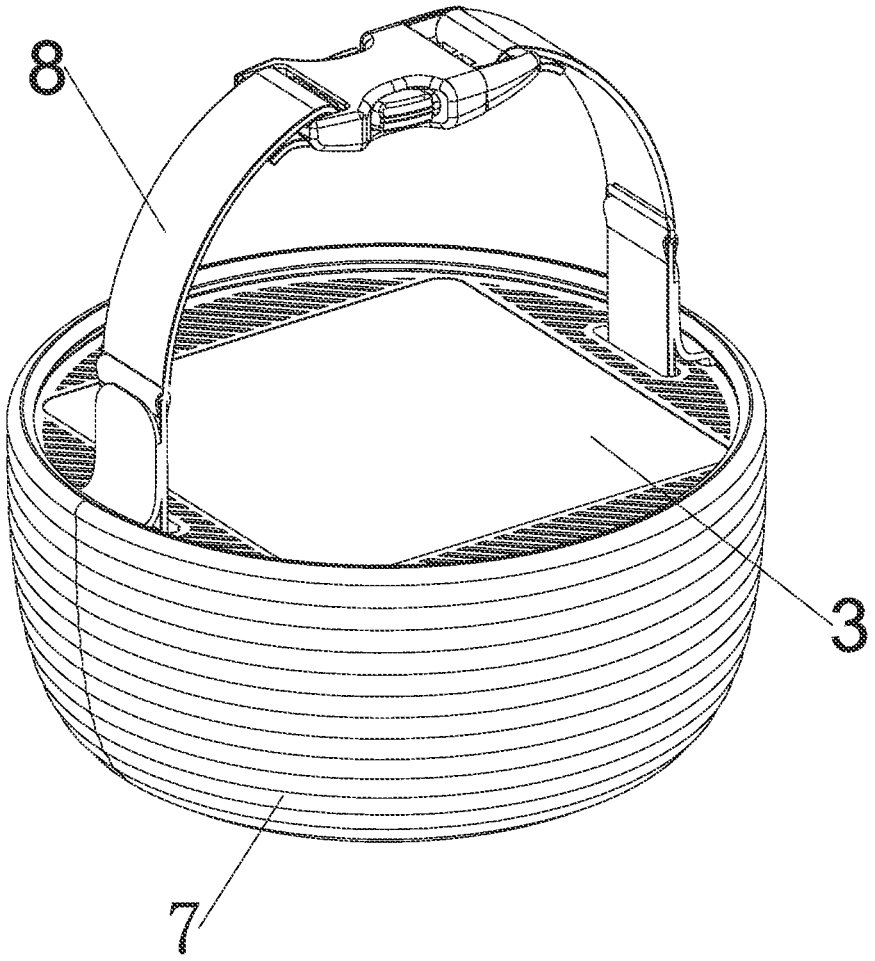
FIG. 1 is a perspective view 1 schematically showing the present disclosure.
Figure 2:
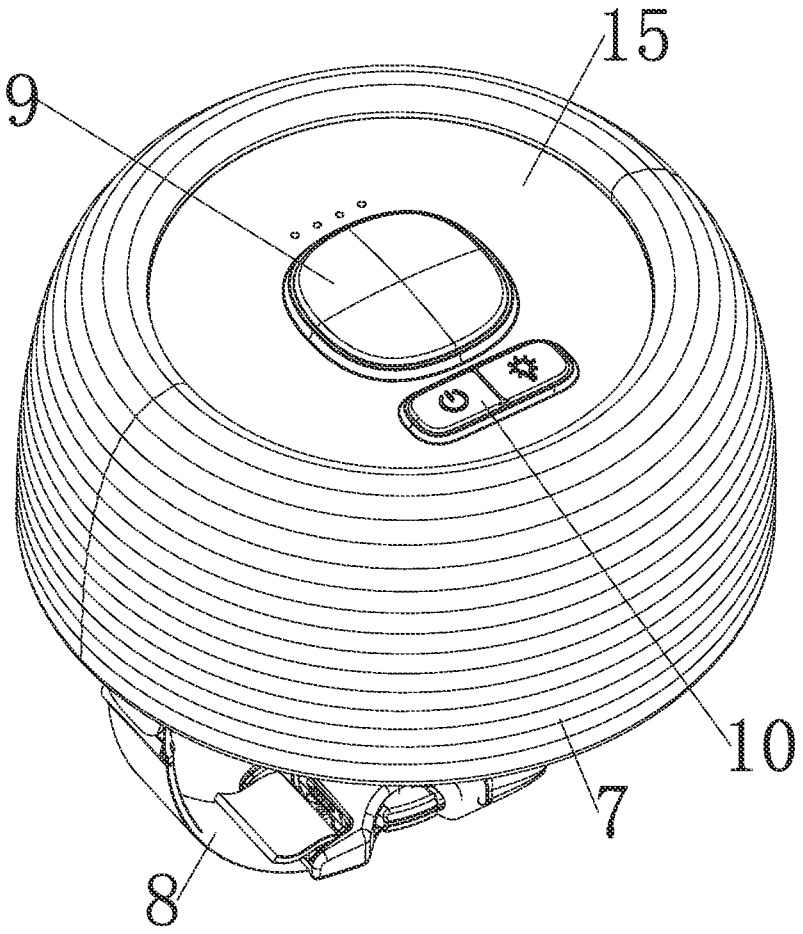
FIG. 2 is a perspective view 2 schematically showing the present disclosure.
Figure 3:
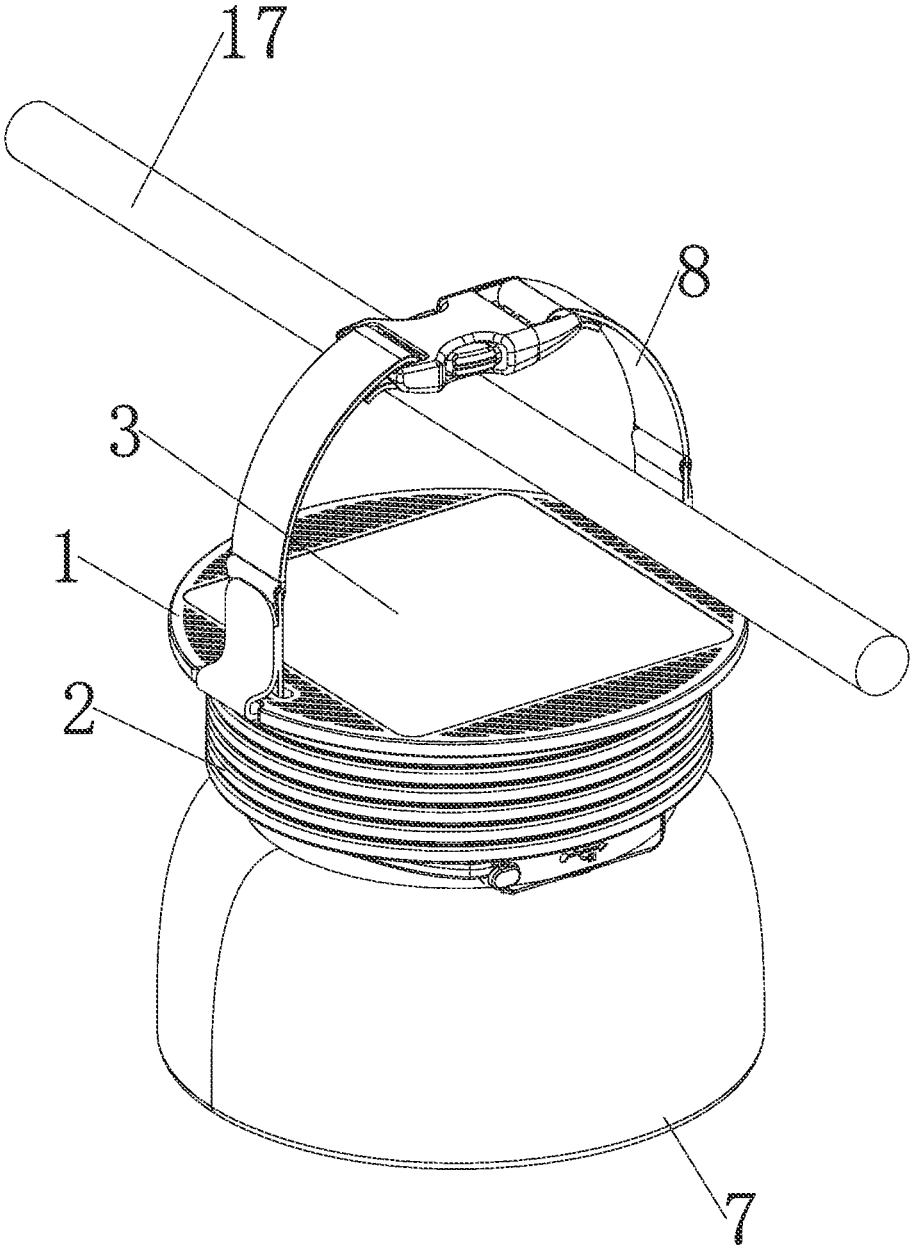
FIG. 3 is a schematic structural diagram 1 schematically showing the downward folded state.
Figure 4:
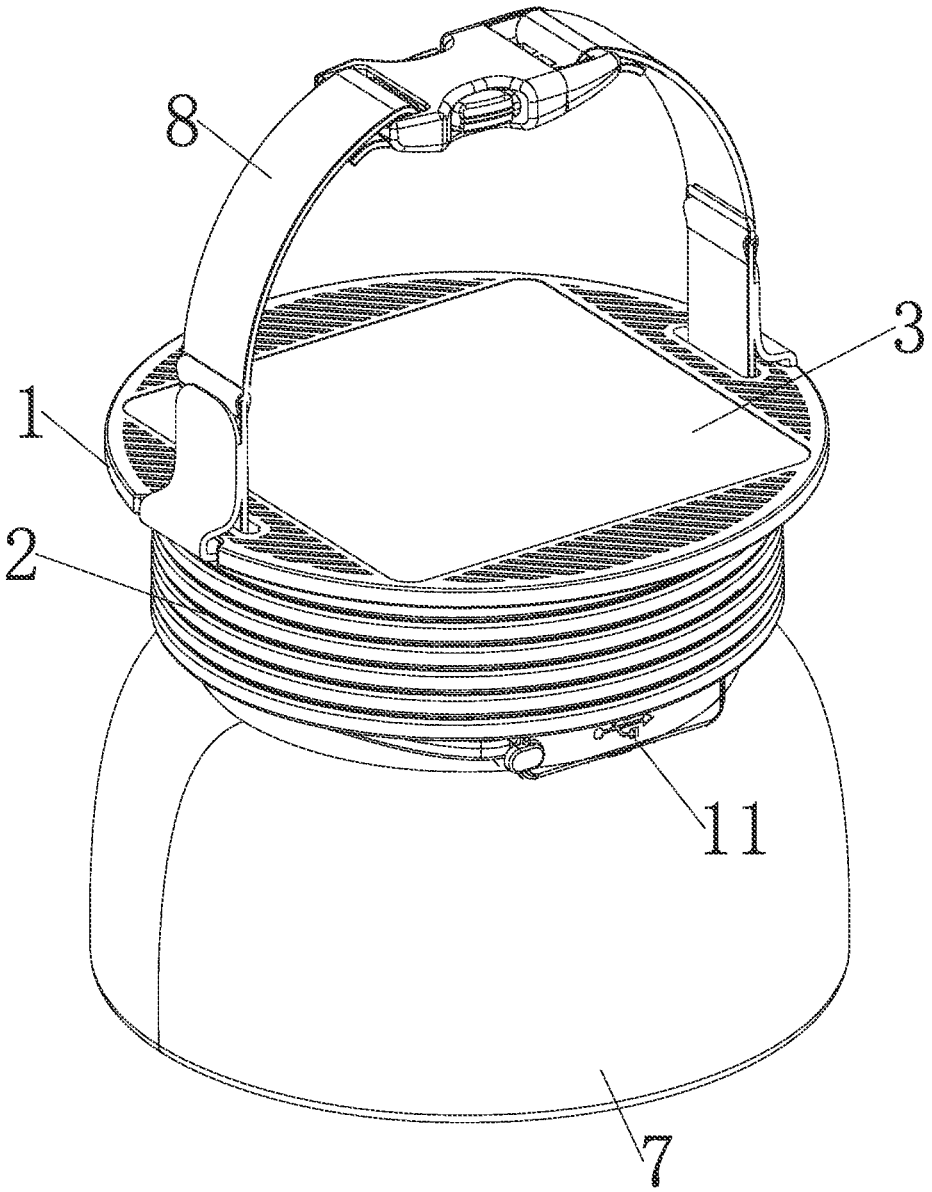
FIG. 4 is a schematic structural diagram 2 schematically showing the downward folded state.
Figure 5:
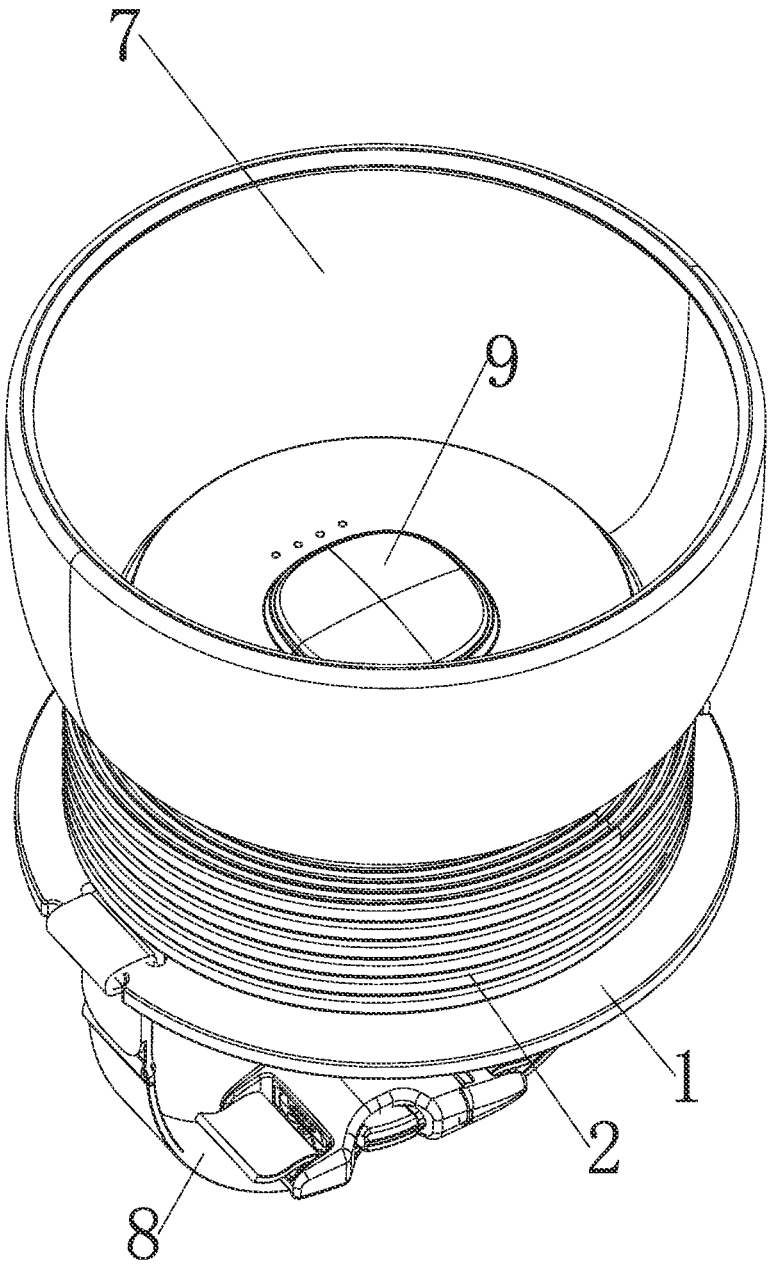
FIG. 5 is a schematic structural diagram 3 schematically showing the downward folded state.
Figure 6:
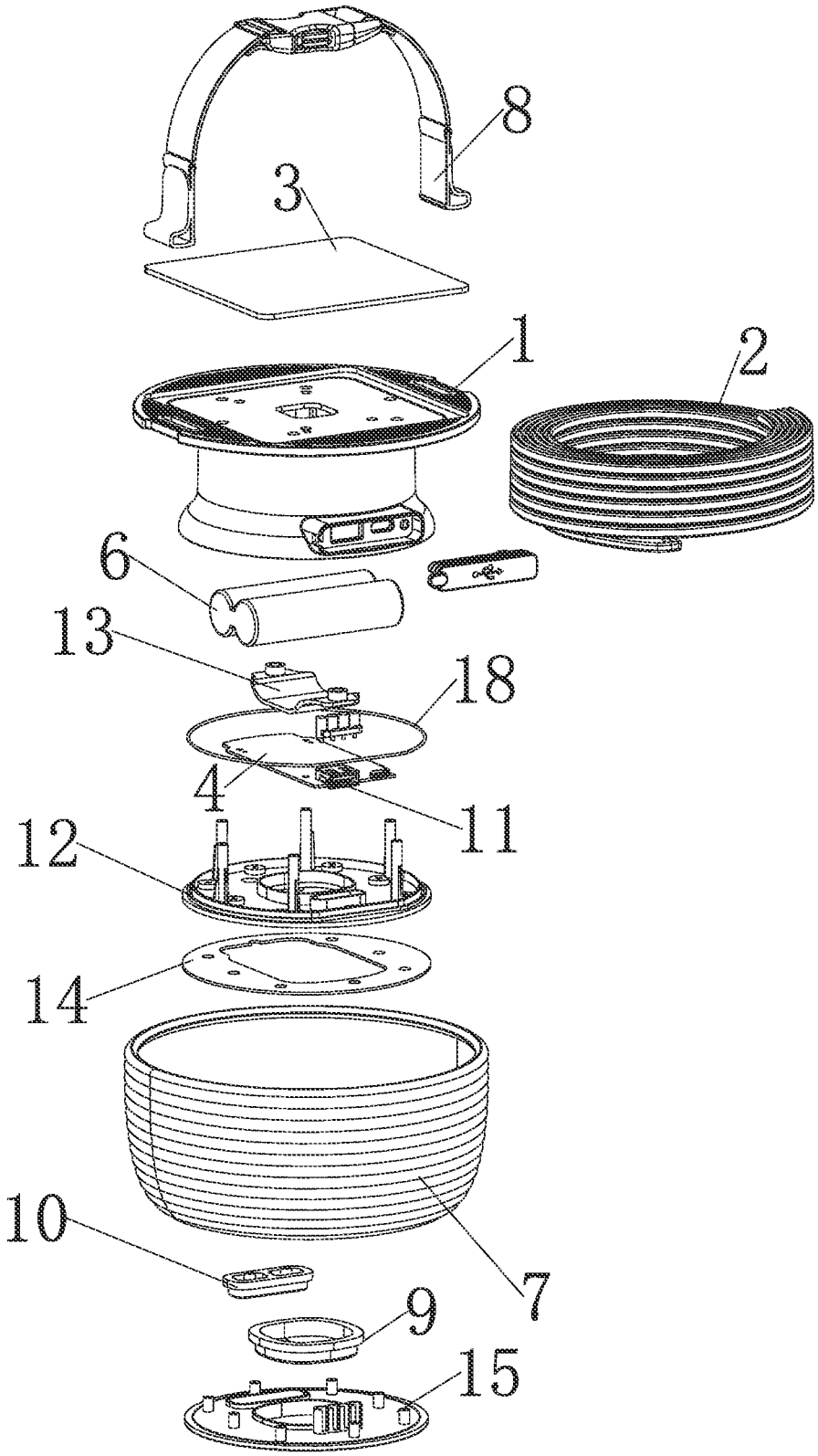
FIG. 6 is an exploded view schematically showing the present disclosure.
Figure 7:
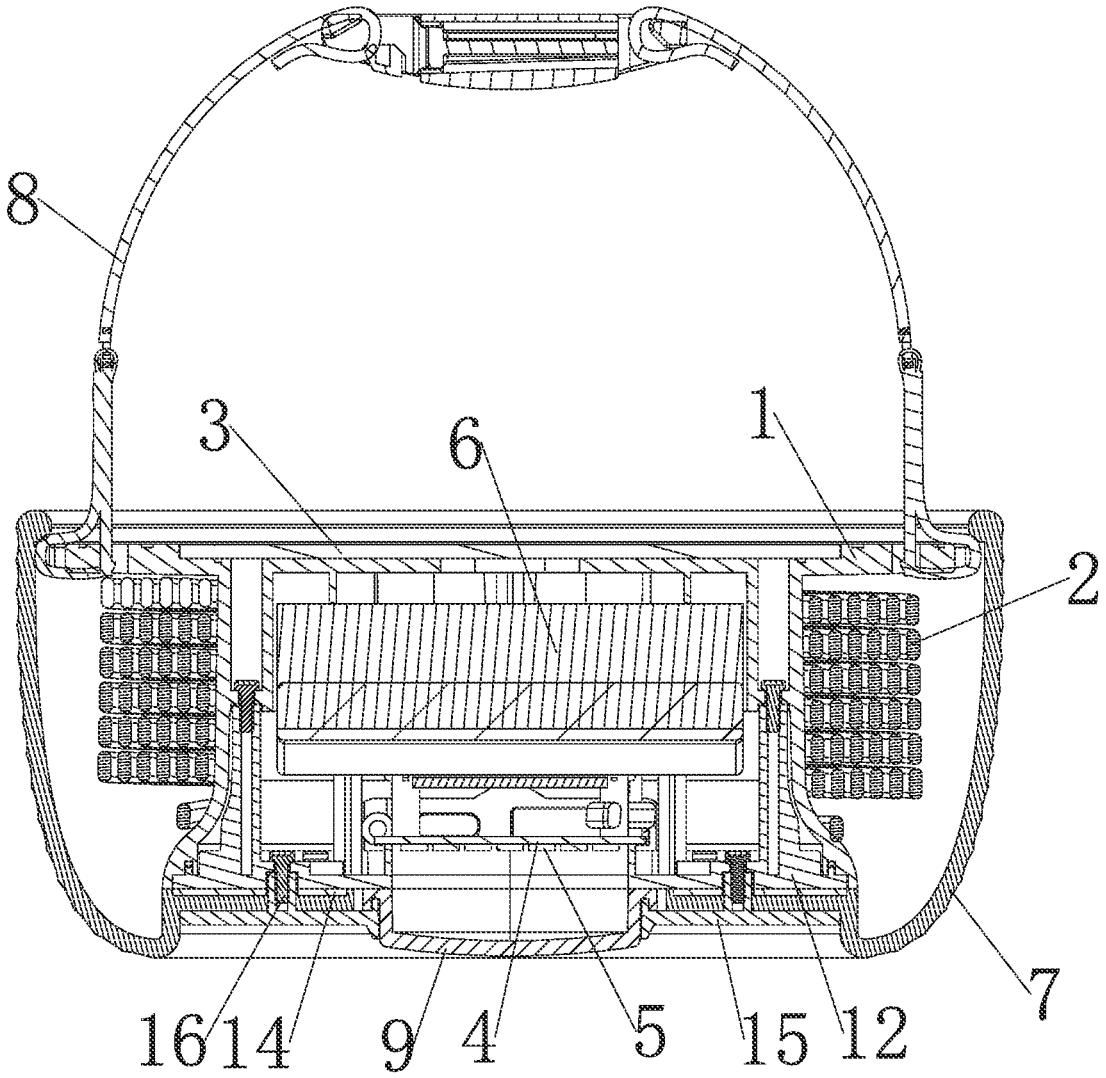
FIG. 7 is a cross-sectional view schematically showing the present disclosure.

Reference symbols in the drawings: 1. main shell; 2. light strip; 3. solar panel; 4, power circuit board; 5. light-emitting assembly; 6, battery; 7. protective cover; 8. hand strap; 9. lampshade; 10. button; 11. charging interface; 12. middle frame; 13. battery holder; 14, annular support plate; 15. annular bottom shell; 16. screw; 17. hanging parts; 18. waterproof ring.

DETAILED DESCRIPTION

Embodiments of the disclosure are described in detail below, but the disclosure can be practiced in many different ways as defined and covered by the Claims.

As an aspect of the present disclosure, a camping lamp is provided, comprising: a main shell 1, a light strip 2, a light-emitting assembly 5, a battery 6 and a protective cover 7, the battery 6 is installed inside the main shell 1, the light strip 2 is detachably wound on the outer peripheral wall of the main shell 1, the light-emitting assembly 5 is arranged at the bottom of the min shell 1, and the battery 5 is respectively electrically connected to the light strip 2 and the light-emitting assembly 5, and the protective cover 7 surrounds the light strip 2. Wherein, the protective cover 7 is a foldable flexible cover or a light-transmitting cover, one end of the protective cover 7 is connected to the main shell 1, and the protective cover 7 is folded in a direction away from the light strip 2 and then wraps around the light emitting surface of the light emitting assembly 5 or releases the wrapping around the light strip 2.

Wherein, the camping lamp further comprises a solar panel 3, a power circuit board 4 and a hand strap 8, the solar panel 3 is mounted on the top of the main shell 1, and the power circuit board 4 is installed inside the main shell 1, the light-emitting assembly 5 is installed on the bottom surface of the power circuit board 4, and the hand strap 8 is installed on the top of the main shell 1.

Wherein, the protective cover 7 is made of silicone. The light strip 2 can be stored outside the main shell 1, or can be pulled out for use.

Wherein, the protective cover 7 has an upper folded state and a downward folded state. When the protective cover 7 is in the upper folded state, it is folded upward to a position matched with the top peripheral edge of the main shell 1, so the protective cover 7 is folded downward in the downward folded state to form a light-transmitting cover of the light-emitting assembly 5. In this way, when the protective cover 7 is folded upwards, a snap-fit sealing connection can be formed between the inner peripheral wall of the upper edge and the outer peripheral edge of the top of the main shell 1, so that the protective cover 7 and the main shell 1 are connected with each other. A sealed installation cavity is formed between them, so that the light strip 2 is located in the sealed installation cavity, and the sealed installation cavity protect the light strip 2. At this time, if the light strip 2 is turned on, the present disclosure can form a colored light effect, and the colored light can be observed from the outside of the protective cover 7. In the downward folded state, the protective cover 7 forms a light-transmitting cover with an opening downward, so that the light of the light-emitting assembly 5 can be better radiated downward. At the same time, the protective cover 7 itself is translucent, and the light of the light-emitting assembly 5 can also forms a warm light emitting cover effect by the protective cover 7.

Wherein, the hand strap 8 is detachably connected to the main shell 1, and the position of the hand strap 8 is not necessarily in the middle, but can also be made on both sides.

Wherein, the main shell 1 is provided with a lampshade 9 for covering the light-emitting assembly 5, and the lampshade 9 can protect the light-emitting assembly 5 and can also provide light such as warm colors.

Wherein, a button 10 is provided on the bottom surface of the power circuit board 4 for turning on or controlling the light strip 2 and the light-emitting assembly 5 and the like.

Wherein, the bottom surface of the power circuit board 4 is provided with a charging interface 11, so that the present disclosure can not only be charged by the solar panel 3, but also be charged directly by an external direct power source. The present disclosure can use solar energy to charge the lithium battery, and can also use USB to charge.

Wherein, a middle frame 1 is installed inside the main shell 1, and the battery 6 is installed on the middle frame 12 through a battery holder 13.

Wherein, the bottom of the middle frame 12 is provided with an annular support plate 14 and an annular bottom shell 15, and the end of the protective cover 7 is located between the annular support plate 14 and the annular bottom shell 15. There are screws 16 for connecting the annular support plate 14 and the annular bottom shell 15. Preferably, the edge of the lampshade 9 is clamped between the annular bottom case 15 and the middle frame 12, in this way, the installation of the protective cover 7 and the lamp cover 9 can be realized.

The camping lamp further comprises a waterproof ring 18, which can be sealed by ultrasonic waves to play a waterproof function.

In the above technical solution, the camping lamp in the present disclosure can be charged by solar energy and DC power supply, which is especially suitable for occasions where it is inconvenient to use external DC power supply for charging, and brings great convenience to outdoor camping. When in use, when the user is walking or exercising outdoors during the day, it can be charged by hanging on the body through the hand strap 8. When lighting is required, the hand strap 8 can be held by hand, and when it needs to be hung, the hand strap 8 can be hung on the hanger 17 (for example, the hanger 17 can be a hanging place in a tent).

In addition, the present disclosure has a variety of usage modes: (1) in the top-folded state, the light strip 2 can be opened, so that the present disclosure can be used as a lamp; (2) in the bottom-folded state, the light-emitting assembly 5 can be opened, so that the present disclosure can be used as a chandelier; (3) the light strip 2 can be opened from the main shell 1 (for example, the length of the light strip 2 can be up to 5 meters), and then the unwound light strip 2 can be arranged in the tent, it is used as the atmosphere light of the tent.

Due to the adoption of the above technical solutions, the present disclosure can be charged by solar energy and DC power supply, and has multiple usage modes, which brings great convenience to users, satisfies the needs of users in different application scenarios, and improves user experience.

The above descriptions are only preferred embodiments of the present disclosure, and are not intended to limit the present disclosure. For those skilled in the art, the present disclosure may have various modifications and changes. Any modification, equivalent replacement, improvement, etc. made within the spirit and principle of the present disclosure shall be included within the protection scope of the present disclosure.

What is claimed is:

1. A camping lamp comprising: a main shell, a light strip, a light-emitting assembly, a battery and a protective cover, the battery is installed inside the main shell, the light strip is detachably wound on the outer peripheral wall of the main shell, the light-emitting assembly is arranged at the bottom of the main shell, and the battery is respectively electrically connected to the light strip and the light-emitting assembly, wherein the protective cover is a foldable flexible cover or a light-transmitting cover, one end of the protective cover is connected to the main shell, the protective cover has an upper folded state and a downward folded state; when the protective cover is in the upper folded, the protective cover surrounds the light strip; when the protective cover is in the downward folded state, the protective cover is folded in a direction away from the light strip and then wraps around the light emitting surface of the light-emitting assembly or releases the wrapping around the light strip.

2. The camping lamp according to claim 1, wherein a middle frame is installed inside the main shell, and the battery is installed on the middle frame by a battery holder.

3. The camping lamp according to claim 2, wherein the bottom of the middle frame is provided with an annular support plate and an annular bottom shell, and the end of the protective cover is located between the annular support plate and the annular bottom shell, the middle frame is provided with a screw for connecting the annular support plate and the annular bottom shell.

4. The camping lamp according to claim 3, wherein a lampshade for covering the light-emitting assembly is provided on the main shell.

5. The camping lamp according to claim 1, wherein the edge of the lampshade is clamped between the annular bottom shell and the middle frame.

6. The camping lamp according to claim 1, wherein the camping lamp further comprising a solar panel, a power circuit board and a hand strap, the solar panel is mounted on the top of the main shell, and the power circuit board is installed inside the main shell, the light-emitting assembly is installed on the bottom surface of the power circuit board, and the hand strap is installed on the top of the main shell.

7. The camping lamp according to claim 6, wherein the protective cover is made of silicone, or the hand strap is detachably connected to the main shell.

8. The camping lamp according to claim 6, wherein a button is arranged on the bottom surface of the power circuit board.

9. The camping lamp according to claim 6, wherein a charging interface is provided on the bottom surface of the power circuit board.

10. The camping lamp according to claim 1, wherein the light strip is arranged to be stored outside the main shell or to be pulled out for use.

11. The camping lamp according to claim 1, wherein when the protective cover is folded upwards, a snap-fit sealing connection can be formed between the inner peripheral wall of the upper edge and the outer peripheral edge of the top of the main shell, so that the protective cover and the main shell are connected with each other, a sealed installation cavity is formed between them, so that the light strip is located in the sealed installation cavity, and the sealed installation cavity protect the light strip.

12. The camping lamp according to claim 1, wherein when the protective cover is in the downward folded state, the protective cover forms a light-transmitting cover with an opening downward, so that the light of the light-emitting assembly can be better radiated downward.

* * * * *